United States Patent [19]

Kamp

[11] Patent Number: 4,497,168

[45] Date of Patent: Feb. 5, 1985

[54] METHOD AND APPARATUS FOR OPEN-END SPINNING

[75] Inventor: Heinz Kamp, Wegberg, Fed. Rep. of Germany

[73] Assignee: W. Schlafhorst & Co., Moenchengladbach, Fed. Rep. of Germany

[21] Appl. No.: 374,244

[22] Filed: May 3, 1982

[30] Foreign Application Priority Data

May 2, 1981 [DE] Fed. Rep. of Germany ..... 3117443
Sep. 7, 1981 [DE] Fed. Rep. of Germany ..... 3135337

[51] Int. Cl.[3] ..... D01H 1/135; D01H 7/898

[52] U.S. Cl. ..... 57/401; 57/328; 57/331; 57/400; 57/408

[58] Field of Search ..... 57/90, 337, 338, 339, 57/401, 408, 411, 413, 328, 331, 341, 347, 400

[56] References Cited

U.S. PATENT DOCUMENTS

| | | | |
|---|---|---|---|
| 2,866,310 | 12/1958 | Mackie | 57/401 X |
| 3,132,465 | 5/1964 | Putman | 57/401 |
| 3,635,006 | 1/1972 | Fehrer | 57/401 |
| 3,763,642 | 10/1973 | Raschle | 57/347 |
| 3,981,137 | 9/1976 | Fehrer | 57/401 |
| 3,994,123 | 11/1976 | Sholly | 57/338 X |
| 4,051,653 | 10/1977 | Mitteregger | 57/401 |
| 4,060,966 | 12/1977 | Konig | 57/401 |
| 4,070,811 | 1/1978 | Fehrer | 57/401 |
| 4,364,223 | 12/1982 | Vignon | 5/401 |

*Primary Examiner*—Donald Watkins
*Attorney, Agent, or Firm*—Herbert L. Lerner; Laurence A. Greenberg

[57] ABSTRACT

A method for open-end spinning, in an apparatus having a stationary fiber-collecting groove formed therein with two ends and a bottom, includes continuously carrying and transporting fibers into the stationary fiber-collecting groove with an airstream, continuously venting the bottom of the groove, withdrawing the fibers from one end of the groove, and continuously uniting the fibers to form a thread, and an apparatus for carrying out the method.

49 Claims, 19 Drawing Figures

FIG.5
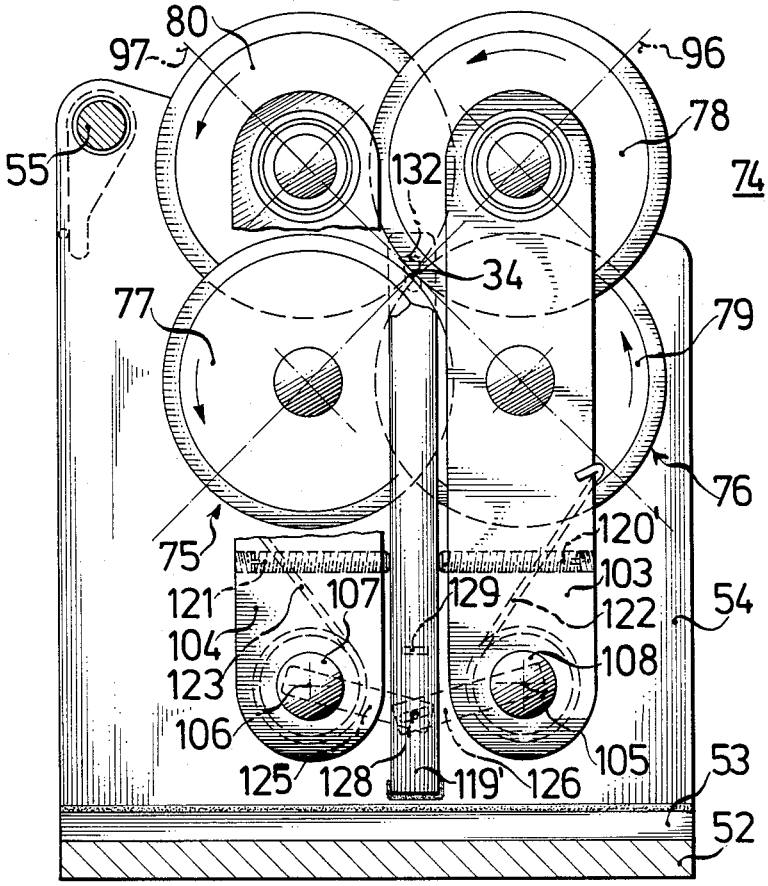
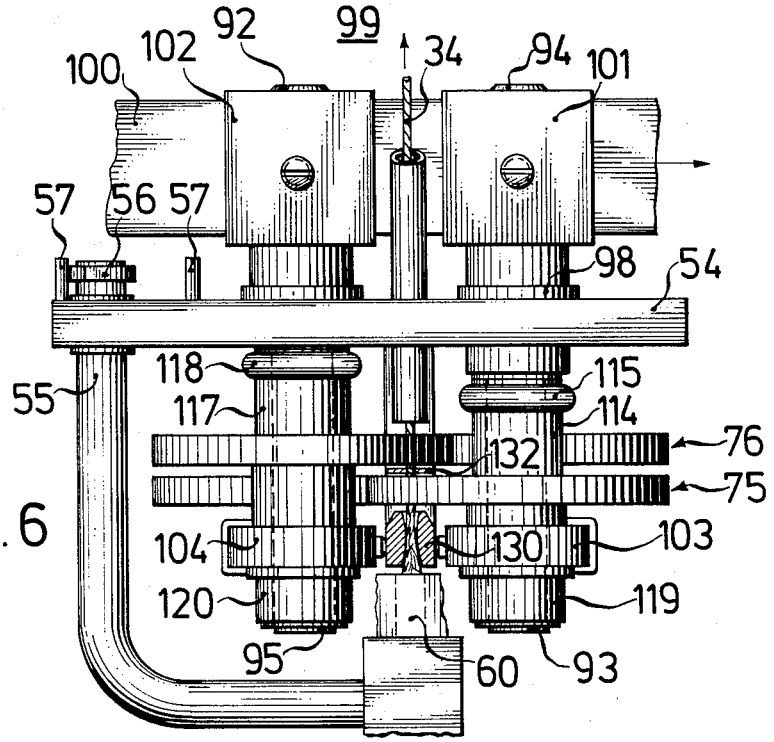
FIG. 6

FIG.7
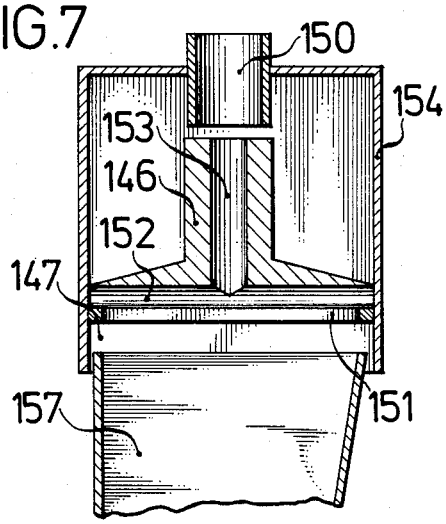
FIG.8
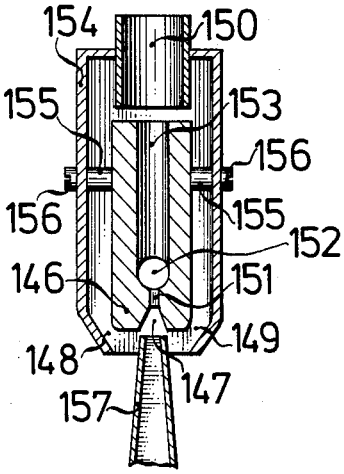
FIG.9
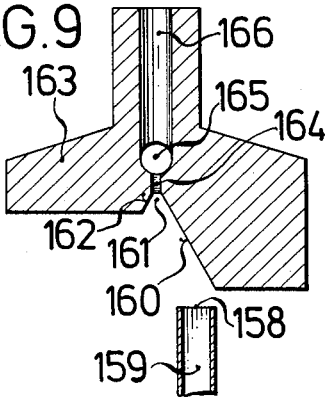
FIG.10
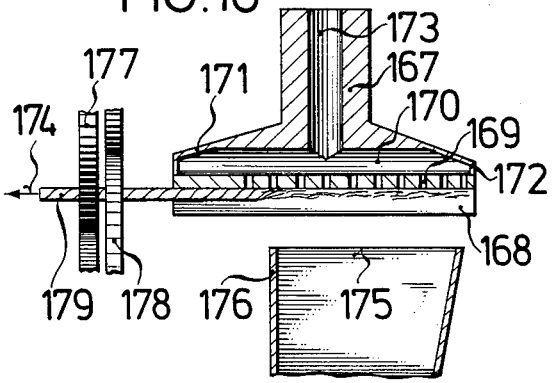
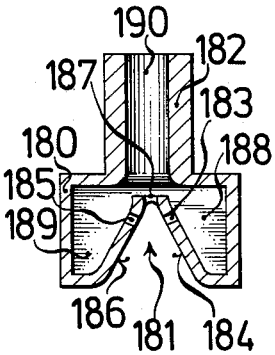
FIG.11
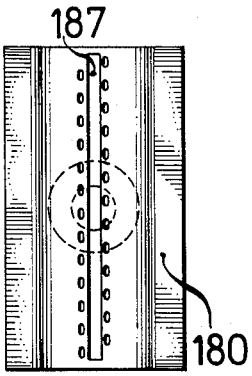
FIG. 12
FIG.13
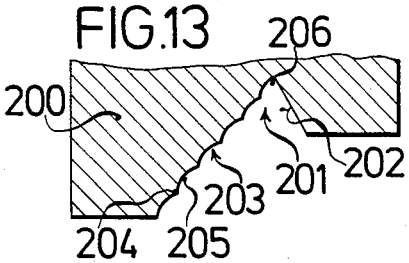
FIG.14
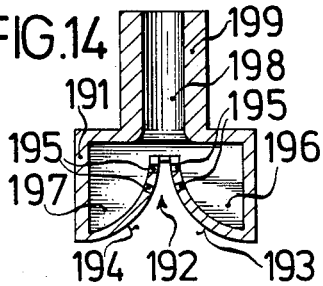

FIG. 17
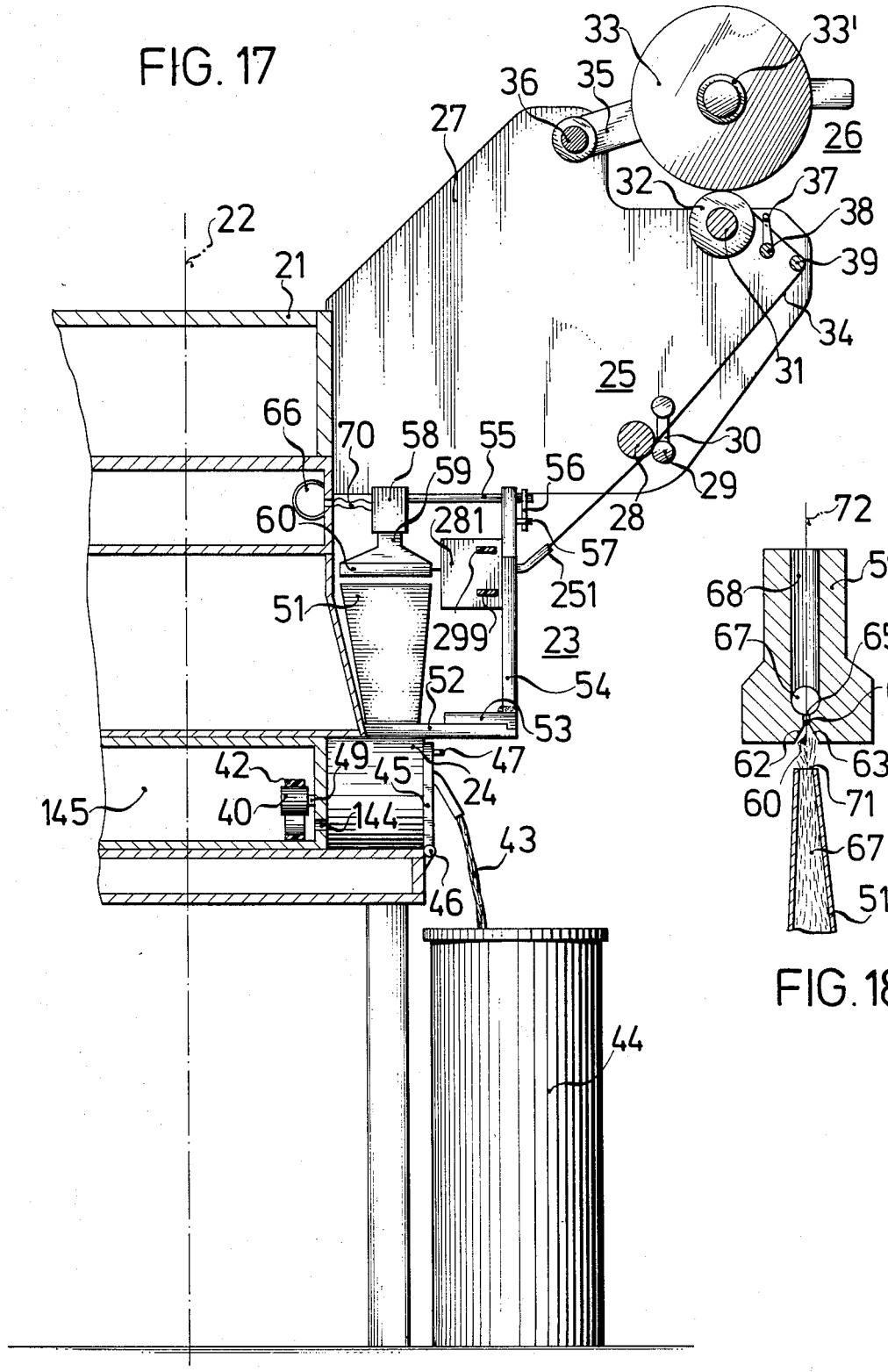
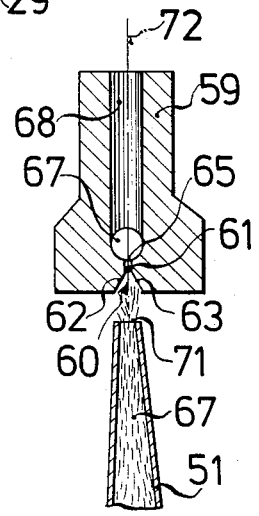
FIG. 18

METHOD AND APPARATUS FOR OPEN-END SPINNING

The invention relates to a method and a device for open-end spinning.

In open-end spinning, the rotor spinning method has found especially wide acceptance. The fibers are taken to a rotating fiber-collecting surface from which they are continuously drawn off and, twisted into a thread. The output of the spinning devices used for this purpose, however, is limited. A spinning rotor has a maximally possible circumferential velocity. The power required for operating the spinning rotors is very large. Even if it were possible technologically to operate spinning rotors with still higher circumferential velocities than is the case today, a disproportionally large extra amount of driving power would be necessary therefor and the cost of precision in the manufacture of the rotors and the rotor bearings would be unjustifiable for an inexpensive mass-produced article such as open-end yarn.

It is an object of the invention to achieve a high production rate with low investment and power costs. According to the invention, this problem is solved by transporting individual fibers carried and transported by an air stream, continuously into an elongated, stationary fiber-collecting groove which may have side walls converging toward the groove bottom, and from which they are then withdrawn continuously from one end, united into a thread.

The fibers are thus continuously deposited by the air stream which carries the individual fibers, in the bottom of the groove of the fiber collecting groove and combined into a thread structure. The withdrawal is done from one end of the fiber-collecting groove, and more specifically, either in the extension of the fiber-collecting groove or at a given angle to the longitudinal direction of the fiber-collecting groove. In the simplest case, the thread twist is obtained by itself, be it that the transport air flows against the fiber-collecting groove at an angle, or be it by air eddies which can also be generated, for instance, by artificial obstacles, or by the thread withdrawal itself.

While the fibers are opened and transported in a proven manner known per se, by combing a sliver by means of needle cylinders or sawtooth cylinders, no rotating or moving part are required at all for the thread formation proper.

If a stronger more highly twisted thread is to be obtained, in a further embodiment of the invention, it is advisable to continuously force a twist on the thread about the longitudinal axis of the thread in the fiber-collecting groove or in its vicinity. This thread rotation may be a true twist or even a false twist. In the fiber-collecting groove itself, a thread twist can be obtained, for instance by an oblique inflow of the fiber-carrying air or of an additional air stream, or by a cyclone-like circling of the fiber bundle by a separate air stream. Adventageously, however, a thread twister can also be arranged in the vicinity of the fiber-collecting groove, which gives the desired twist to the withdrawn thread.

A good spinning result is achieved if the individual fibers, in a further embodiment of the invention, are continuously fed to the fiber-collecting groove in the form of a fiber balloon. Such a fiber balloon enters the fiber-collecting groove in the longitudinal direction of the latter. It is ensured thereby that all fibers are bound into the developing thread. In addition, a high degree of uniformity of the thread is ensured thereby.

In particular, if the carrying air stream is only weak, no special measures have to be taken for venting the bottom of the groove. For higher production rates, for stronger air streams and in the case of large quantities of fiber, however, it is advantageous if, in a further embodiment of the invention, the groove bottom is vented continuously. This can already be achieved, for instance, by simple perforations in the bottom of the groove. However, it is better and more effective if the venting is forced. This is accomplished, for instance, through the action of suction air onto the above-mentioned perforations.

Compared to open-end spinning with rotating fiber-collecting surfaces, the invention requires a much smaller amount of power, the noise developed is much less, and problems with rotor bearings, rotor-bearing wear, heating of bearings, the rotor drive, and the wear of drive belts, do not occur at all.

For implementing the method, an open-end spinning device is proposed which is characterized by a stationary elongated fiber-collecting groove which may have side walls converging toward the bottom of the groove, a fiber guide canal which opens in front of the fiber collecting groove and is connected to a fiber-opening device, and a thread-withdrawing device arranged in front of one end of the-fiber collecting groove.

The fiber-collecting groove is elongated, i.e. it is not closed in itself and rather has a beginning and an end. A special type of an elongated fiber-collecting groove is a straight fiber-collecting groove. The straight fiber-collecting groove has various advantages. In the first place, there are manufacturing advantages. Secondly, the acceleration of the fibers in the direction toward the thread withdrawal can be accomplished better by a straight fiber-collecting groove. In addition, a good spinning result is obtained. The fiber opening device and the fiber-guide canal are opening devices known from open-end rotor spinning. The thread-withdrawal device is also known from open-end rotor spinning. Common use is made of cylinder pairs, in which one cylinder is driven and the other cylinder rests due to its own weight or by spring force on the driven cylinder. The thread placed between the cylinders is then withdrawn continuously and can be wound behind the thread withdrawal device, for instance on a bobbin.

Adventageously, a thread twister is arranged between the fiber-collecting groove and the fiber-withdrawing device. As already mentioned, this can be a conventional thread twister. However, a particularly suitable new thread twister will be described later on.

Adventageously, the length of the fiber-collecting groove exceeds the length of the fiber material to be processed. It is the purpose of this design rule to ensure that all fed-in fibers are reliably bound into the thread and are not damaged in the process.

In a further embodiment of the invention, the fiber-collecting groove has definite designs. It may, for instance, have a V-shaped cross section. Its side walls may be convex or concave. One side wall may also be convex and the other concave. The combination of a convex or concave side wall with a planar one is also possible. It is advantageous if the side walls of the fiber-collecting groove are smooth and serve as sliding surfaces for the fibers. The kinetic energy inherent in the fibers and the flowing air makes the fibers slide along the sliding surface into the narrowed groove bottom, after they have touched the sliding surface.

Two further embodiments of the fiber-collecting groove are claimed specifically. One is the embodiment in which the side walls of the fiber-collecting groove are planar, the other is the embodiment in which the side walls of the fiber-collecting groove are wavy in such a manner that the troughs of the waves extend parallel to the bottom of the groove. The last-mentioned measure is provided to bring about an operation in which the fibers are preoriented in the wave troughs until they are finally oriented in the bottom of the groove and are aligned in the longitudinal direction.

If only one side wall of the fiber-collecting groove is to serve as the sliding surface for the fibers, then this side wall is advantageously higher than the opposite side wall. Material savings are then achieved at the fiber-collecting groove and the guidance of the air is improved.

For improving the air guidance and for the purpose of suctioning and holding the fibers in the groove bottom, it is proposed in a further embodiment of the invention that the groove bottom also has at least one perforation. Such a perforation may consist, for instance, of a slit extending along the bottom of the groove. On the other hand, the perforation may also consist of holes arranged in a row. One or more rows of holes are particularly advantageous if short fibers are spun into a thread. Such holes can consist, for instance, of drill holes or screen-like perforations.

For aiding the venting of the groove, for improving the holding of the fibers, and for the overall purpose of providing a better spinning result, the perforations of the fiber-collecting groove are advantageously connected to an underpressure or suction source. Uniform distribution of the suction air is obtained if a collecting canal is arranged between the perforations and the suction air source in the body of the fiber-collecting groove. Such a collecting canal can be made very simply in the form of a bore hole into which all of the perforations lead.

Although there are several possibilities for the placement of the perforations, all have their special advantages. In the simplest case, the perforation can extend over the entire length of the fiber-collecting groove. The relationship between the fiber-guide canal and the fiber-collecting groove is then rather uncritical. The perforation however, can also extend over only part of the length of the fiber-collecting groove. This is preferably that part of the fiber-collecting groove which is opposite the thread-withdrawal side. This arrangement of the perforations also has its advantages; since the fiber feed can then be directed against the perforations and in the non-perforated part of the fiber-collecting groove, the thread twist can develop while being completely undisturbed.

Good air guidance is obtained if, according to a further proposal of the invention, the body of the fiber-collecting groove has air-suction nozzles on both longitudinal sides. The body of the fiber-collecting groove is mentioned to indicate that in this case the fiber-collecting groove proper is worked into a compact body which may be block-like.

In these variants, not only the bottom of the groove, but also the two outer edges of the fiber-collecting groove are vented. The air-suction nozzles can be connected to the same underpressure or suction source as the perforations. The last-mentioned measures, not only provide an advantageous air guidance; but they also prevent impurities suspended in the ambient air from entering between the fibers or into the perforations. In order to realize these advantages it is proposed in a further embodiment of the invention that a housing which is open on one side and encloses the body of the fiber-collecting groove at a space, forms the air-suction nozzles. Separate air-suction nozzles are therefore not necessary. Although the fiber-collecting groove is fixed during the spinning operation, it may be advantageous to arrange the body of the fiber-collecting groove so that it can be swung from the operating position into an inspection position. In the operating position, the possibility of locking is provided. In the inspection position, the fiber-collecting groove can be cleaned and inspected. Inspection for wear and foreign material is also facilitated thereby. Special attention is also given to the fiber-guide canal. In a further embodiment of the invention it is proposed that the fiber-guide canal has a slit nozzle extending parallel to the fiber-collecting groove at the point of the fiber exit. Such a slit nozzle is highly suitable for forming the desired fiber balloon and for delivering it into the fiber-collecting groove. The slit nozzle can be directed toward the groove bottom. Most fibers than are transported immediately into the groove bottom without using one of the side walls of the fiber-collecting groove as a sliding surface. The slit nozzle, however, can also be directed toward a side wall of the fiber-collecting groove. Then, this side wall serves as the sliding surface for most fibers. If the slit nozzle is somewhat wider, then individual fibers can definitely also reach both side walls in case the slit nozzle is directed toward the bottom of the groove, and can use them as the sliding surface. There are also several possible combinations.

In order to permit the spinning device to be reset quickly for different fiber materials and different spinning conditions, it is advantageous to make the distance from the slit nozzle to the groove bottom and/or to the side wall of the fiber-collecting groove adjustable.

Like the arrangement of the slit nozzle, the arrangement of the fiber-guide canal also determines the desired spinning result. It is therefore proposed in a further embodiment of the invention that the fiber-guide canal is either directed perpendicularly to the fiber-collecting groove or that it is arranged somewhat away from the direction of the fiber thread-withdrawal or somewhat against the direction of the thread-withdrawal. An arcuate design of the fiber-guide canal may also be advantageous. The choice of which arrangement of the fiber-guide canal is better depends on the desired spinning result and the fiber material used.

The length of the slit nozzle and its arrangement relative to the fiber-collecting groove also influence the spinning. It is therefore proposed that the slit nozzle either extends over the entire length of the fiber-collecting groove or only over the part provided with perforations, or also only over part of the portion of the fiber-collecting groove provided with perforations, and more specifically, over the part facing away from the thread withdrawal. The slit nozzle, therefore is in no case longer than the fiber-collecting groove, but advantageously, it may be substantially shorter. The length of the fiber-collecting groove is also matched to the spinning result and to the fiber material used.

It has already been mentioned that a conventional thread twister, a rotating tube or the like can be used. With the high production rate expected of the invention. however, it is important to see to it that with the twister, the speed of rotation does not become too high. It is therefore proposed in a further embodiment of the invention that the thread twister consist of two roller pairs which are arranged one behind the other in the thread-withdrawal direction and the axes of rotation of which are removed in pairs equally far from the longitudinal axis of the thread, and of which the circumferences of the individual rollers are brought close to each other down to the thread diameter. The individual rollers of such roller pairs can be made with any diameter. In generating the twist of the thread, only the circumfertial velocity of the rollers is important. Since the rollers can be given a relatively large diameter, their speed of rotation can be low. For this reason, the problems with bearings for rotating parts can be reduced to a minimum. Advantageously, all four individual rollers of the roller pairs are driven in the same direction with the same circumferential velocity. It is not necessary in this case that all four rollers have the same outside diameter although this is a rather practical measure. The two roller pairs can have entirely different diameters of the individual rollers. The individual rollers are advantageously also given a friction covering. The friction covering may consist of rubber-elastic material. If a friction covering is mentioned, the case in which the entire roller consists of a material with a high friction coefficient is also to be included.

All four rollers come into contact with the thread and it is desirable that they act uniformly on the thread. This also requires uniform distribution of the engagement points of the rollers over the thread circumference. Therefore, it is proposed that the plane going through the axes of rotation of the first roller pair penetrates the plane going through the axes of rotation of the second roller pair approximately at right angles. Thereby, expression is to be given to the desire that the rollers are distributed uniformly, which also includes the possibility of alternatingly using rollers of larger diameter and smaller diameter.

Advantageously, one roller of each roller pair is supported in a fixed manner and the other roller is movably supported. The mobility of the second roller is desirable for two reasons. Firstly, the force of the action on the thread can be set by the weight of the roller itself or by a spring force, and secondly, the movable rollers can be swung to one side, for the purpose of inspection or starting the spinning, thereby making room. In a further embodiment of the invention, it is proposed that each of the two movably supported rollers is rotatably supported at at least one strap and that the strap can be swung either about the axis of rotation of the fixed supported roller or about an axis disposed vertically under the above-mentioned axis of rotation. Under this assumption, it is further proposed that the rollers which are supported in a fixed manner, have an external drive and the movably supported rollers are driven by the rollers which are supported in a fixed manner. The external drive can consist, for instance, of a tangential belt drive, particularly a flat belt drive. The roller of the one roller pair which is supported in a fixed manner is advantageously connected to a movably supported roller of the other pair of rollers by drive elements, which consist, for instance of a belt drive and in particular a serrated belt drive.

If the rollers which are movably supported are pivotably supported about the rollers of the other roller pair which are supported in a fixed manner, then driving the movably supported rollers by the roller supported in a fixed presents no difficulty at all. Gear drives could also be used for this purpose. If, on the other hand, the straps which carry the movably supported rollers are not supported in the axis of the stationary rollers, then it is advisable to use a resilient belt drive, using rubber cord or the like, because the distances between the rollers coupled drive-wise with each other change when the straps are swung out.

In a further embodiment of the invention it is proposed that the swinging motion of the movably supported rollers extends from an operating position (spinning position, thread twisting position), over a distance corresponding to several times the thread diameter being provided between the rollers. In the inspection position, the thread is completely free and is not rotated. It is also advantageous for cleaning the thread twister to provide an inspection position. The spinning can be started advantageously if the thread twister is in the inspection position. When starting the spinning by hand, a thread section is advanced against the normal thread-withdrawal direction up into the fiber-collecting groove. If the thread twister was not in the inspection position, then this backing up of the thread for the purpose of starting the spinning would cause difficulties.

Since in rejoining by hand, only one hand is free to operate machine parts, it is furthermore proposed that the movably supported rollers have a common operating element for the purpose of shifting from the operating position to the inspection position and vice versa. When joining the thread, the thread twister can first be brought manually into the inspection position, then the thread end can be introduced and thereupon the thread twister can again be reset into the operating position with only one hand.

Advantageously, thread guiding means are arranged between the fiber-collecting groove and the fiber-withdrawal device. These thread-guide means should support the thread which may not yet be solidified toowell, without hindering the binding-in of fibers or the thread twist. Such thread-guidance means can be arranged, for instance, between the fiber-collecting groove and the thread twister, as well as between the thread twister and the thread-withdrawal device. Suitable thread-guiding means are tubes, nozzles, apertures, funnels or eyes. The somewhat flatter structures are arranged preferably between the thread twister and the fiber-collecting groove and the somewhat more elongated structures such as tubes, are disposed between the thread twister and the thread-withdrawal device. Especially with thin threads, it is very advantageous to also place a thread guide between the roller pairs of the thread twister. This thread guide consists preferably of an aperture. This is, for instance, a thin strip of sheet metal with a round or elongated hole with rounded edges. A narrow slit, which is open at the top, can also be worked into the sheet metal part.

It has already been mentioned that the movably supported rollers can be pressed against the counter rollers or against the thread by spring force or by the force of gravity. In a further embodiment of the invention it proposed for this purpose that the strap carrying the one movably supported roller is loaded by a spring, the spring force of which acts in the direction toward the operating position (spinning position) of the roller. This may be, for instance, a tension spring or a wound coil spring. The wound coil spring is then advantageously looped around the swivel axis of the strap. Such springs have the advantage of having a spring characteristic which can be chosen and if necessary, adjusted or readjusted. It is further proposed that the operating position (spinning position) of the movably supported roller is fixed by an adjustable stop device which acts on the strap. Such a stop device may consist, for instance, of a simple adjusting screw. The adjustment of the spinning position is so important because this adjustment permits the distance between the individual rollers of the roller pairs in the thread twister to be accurately adjusted to the thread to be spun.

To increase the production rate and to improve the spinning result, it is furthermore proposed that the thread twister be provided with a false twisting element, known per se. This may be, for instance, a rotating tube.

In a further embodiment of the invention it is proposed that the false twisting element rest on the circumference of two friction roller pairs at a total of four points and be held by the force of a magnet in its position.

Advantageously, at least one friction roller has an external drive element.

Embodiment examples of the invention are shown in the drawings. The invention will be described and explained in greater detail, referring to these embodiment examples.

FIG. 5 is a rear-elevational view of parts of the thread twister of the device according to FIG. 1;

FIG. 6 is a fragmentary top plan view of the thread twister of the device according to FIG. 1;

FIGS. 7 to 11 are fragmentary cross-sectional view of fiber-collecting grooves with and without a fiber-guide canal;

FIG. 12 is a bottom plan view of a fiber-collecting groove according to FIG. 11;

FIG. 13 is a fragmentary cross-sectional view through a fiber-collecting groove;

FIG. 14 is a cross-sectional view through another fiber-collecting groove;

FIG. 17 is a fragmentary side-elevational view of a further embodiment of the invention;

FIG. 18 is a cross-sectional view of a fiber-collecting groove of the further embodiment and a fiber-guiding canal.

Figure 1:
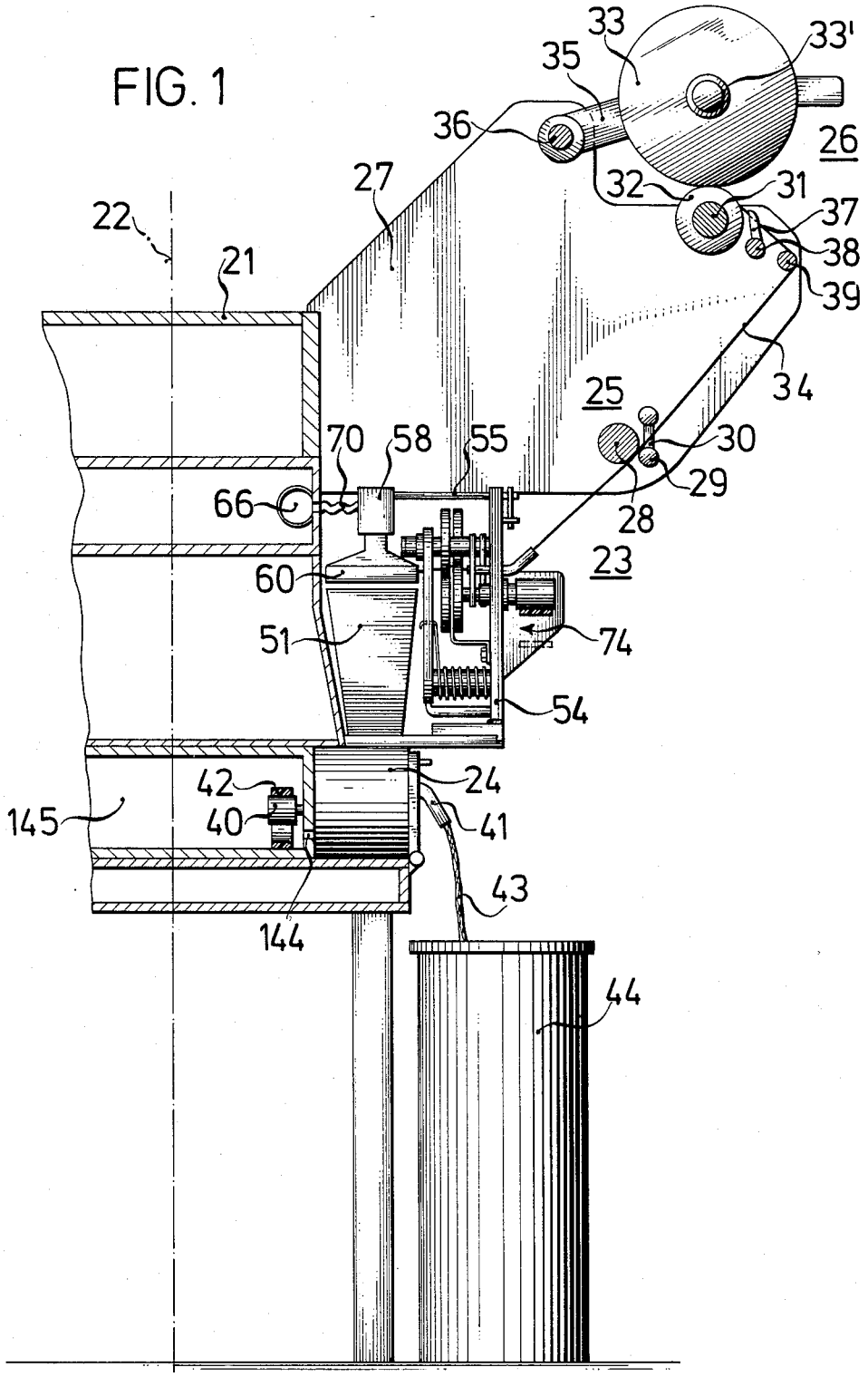
FIG. 1 is a fragmentary side-elevational view of a frame of a two-sided spinning machine having an open-spinning device.

In the embodiment example according to FIGS. 1 to 5 and particularly in FIG. 1 thereof, there is seen a machine frame 21 of a double-sided open-end spinning machine, the symmetry plane of which extends along a dot-dash line 22. While the machine frame 21 is shown in cross-section, FIG. 1 shows an individual open-end spinning device 23 in a side view. The open-end spinning device 23 has a fiber opener device 24, a thread-withdrawing device 25 and a thread-winding device 26. A side plate 27 carries the thread-withdrawing device 25 as well as the thread winding device 26. The thread-withdrawing device 25 comprises a continuously driven shaft 28 which goes through from device to device, and a drawing-off roller 29 which is supported in a rocking lever 30.

The thread winding device 26 also has a continuously rotating shaft 31 which goes through from one device to another and carries a bobbin driving cylinder 32. The bobbin driving cylinder 32 frictionally drives a bobbin 33 on which the spun thread 34 is wound. The bobbin 33 is supported by a bobbin holder 35 which can be swung about a shaft 36 which is fastened to the side plate 27. The thread winding device 26 also includes a reciprocating thread guide 37, which is mounted on a longitudinally movable rod 38 which is likewise supported in the side plate 27 and goes through from device to device. A thread guide is also shown in cross section in FIG. 1.

FIG. 1 shows a knurled drive element 40 and a thread baffle 41 of the fiber opener device 24. The knurled drive element 40 is driven by a flat belt 42. The sliver 43 to be processed is supplied from a can 44.

Figures 2, 3:
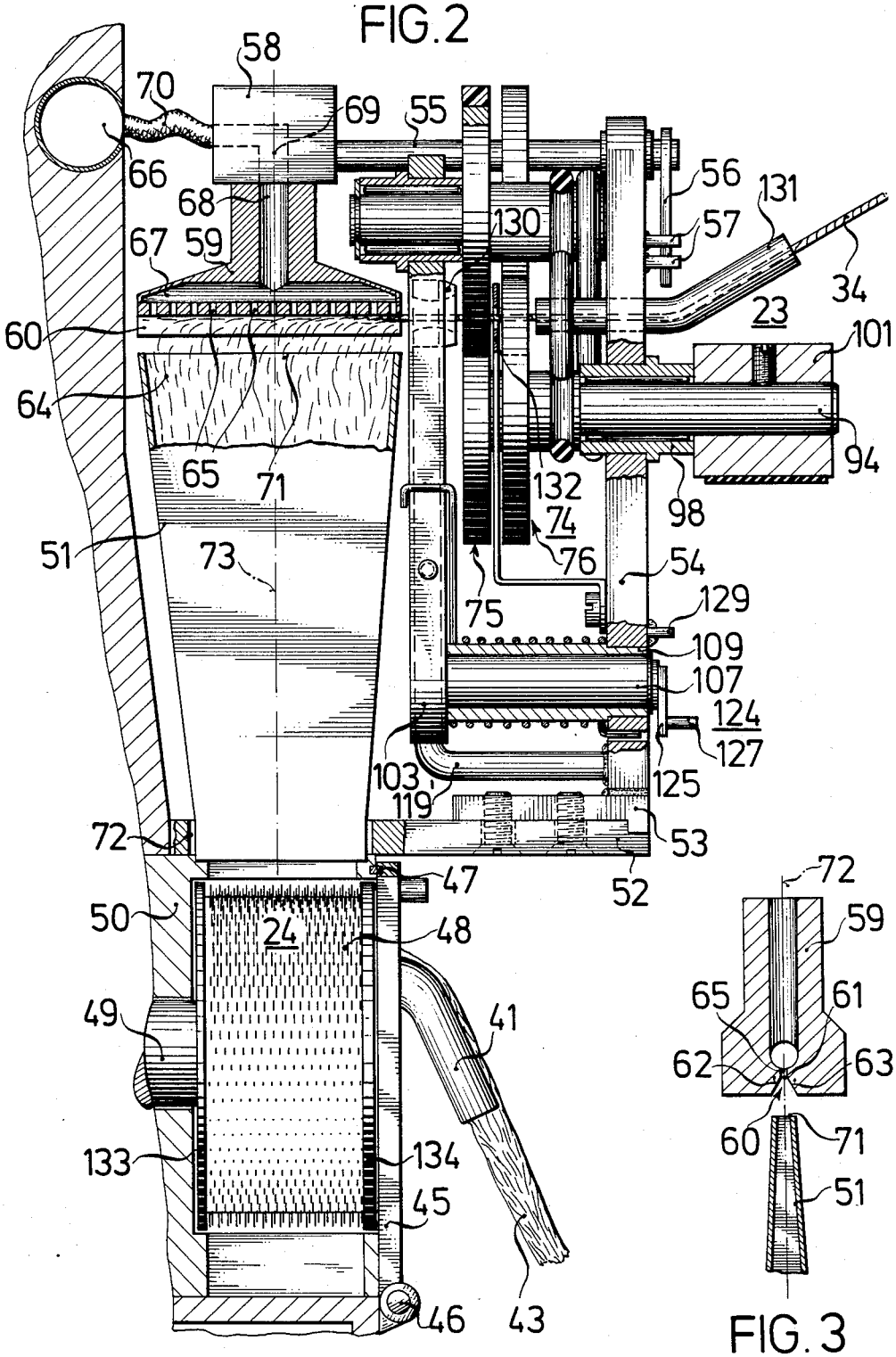
FIG. 2 is a view similar to FIG. 1, but on an enlarged scale and parttly broken away.
FIG. 3 is a fragmentary cross-sectional view of a fiber-collecting groove and a fiber-guiding canal.

Further details of the open-end spinning device 23 are shown in particular in FIG. 2. It can be seen here that the sliver baffle 41 is mounted on a cover 45 which can be swung about a hinge 46 and is detachably held by a magnet lock 47. In the interior of the fiber-opening device 24 there is, among other things, an opener cylinder 48, having a shaft 49 which is connected to the above-mentioned knurled element 40. The housing 50 of the fiber opener device 24 is followed as viewed in the upward direction by a fiber-guide canal 51. Starting from the machine frame 21, in the forward direction, there is seen a cross piece 52 to which the base 53 of a front panel 54 is fastened by means of screws. At the upper right hand corner of the front panel 54, is a holding rod 55 which is pivoted and secured against longitudinal shifting. At the end of the holding rod 55 there is a setting lever 56 which can be swung in an angular range that is limited by stop pins 57. At the other end of the holding rod 55 there is a carrier 58 for the body 59 of a fiber-collecting groove 60. The fiber-collecting groove 60 is shown in its operating position. The setting lever 56 ensures that this operating position is retained in stationary relationship without external action.

The cross section through the fiber-collecting groove 60 shown in FIG. 3 indicates that the fiber-collecting groove has a V-shaped cross section with a narrowed-down groove bottom 61.

FIG. 2 shows that the fiber-collecting groove 60 is elongated and that the fiber-guiding canal 51 opens in front of the fiber-collecting groove 60. The side walls 62, 63 of the fiber-collecting groove 60 are smoothed and serve, among other things, as sliding surfaces for the fibers 64 fed-in through the fiber-guiding canal 51. The side walls are not only smoothed but in this case, they are planar walls. The groove bottom 61 has perforations 65. FIG. 2 shows that these perforations consist of holes arranged in a row. The perforations 65 are connected to a schematically shown under-pressure or suction source 66. To this end, a collecting main 67 which becomes a canal 68 is arranged in the body 59 of the fiber-collecting groove 60. The canal 68 merges into a canal 69 which is arranged in the carrier 58 and to which a flexible hose 70 is connected which leads to the underpressure source 66. As FIG. 2 shows, the perforations 65 extend over the entire length of the fiber-collecting groove 60.

At the exit, the fiber-guide canal 51 forms a slit nozzle 71 which is parallel to the fiber-collecting groove. The slit nozzle 71 is directed toward the groove bottom 61 but in such a manner that the emerging fibers also touch the side walls 62 and 63 as is indicated, for instance, in FIG. 3. Since the fiber-guiding canal 51 has a base 72 which has parallel lateral surfaces, it can be shifted in the cross piece 52 in the vertical direction, so that the distance from the slit nozzle 71 to the groove bottom 61 or the lateral walls 62 and 63 of the fiber-collecting groove 60 is adjustable.

In the present embodiment example, the fiber-guiding canal 51 is directed perpendicularly toward the fiber-collecting groove 60, i.e. it has, according to FIG. 3, a symmetry plane 72 in common with the fiber-collecting groove 60, and in accordance with the cut-away side view according to FIG. 2, its symmetry plane 73 is perpendicular to the fiber-collecting groove 60. According to FIG. 2, the slit nozzle 71 extends over the entire length of the fiber-collecting groove 60.

FIG. 1 especially shows that the thread-withdrawing device 25 is arranged in front of one end of the fiber-collecting groove 60. The intention is to provide a thread-withdrawal device arranged at a distance from the above-mentioned end of the fiber-collecting groove. The thread-withdrawal device can accordingly be arranged alternatively along a straight line in front of the end of the fiber-collecting groove or, as in this example, somewhat offset laterally. In order to make this lateral offset of the thread-withdrawing device possible without detrimetal secondary effects, thread-guiding means are provided which will be discussed later on.

According to FIG. 1, a thread twister, designated overall with reference numeral 74, is arranged between the fiber-collecting groove 60 and the thread-withdrawing device 25. The finer details of the thread twister 74 are shown in FIGS. 2, 4, 5 and 6.

Figure 4:
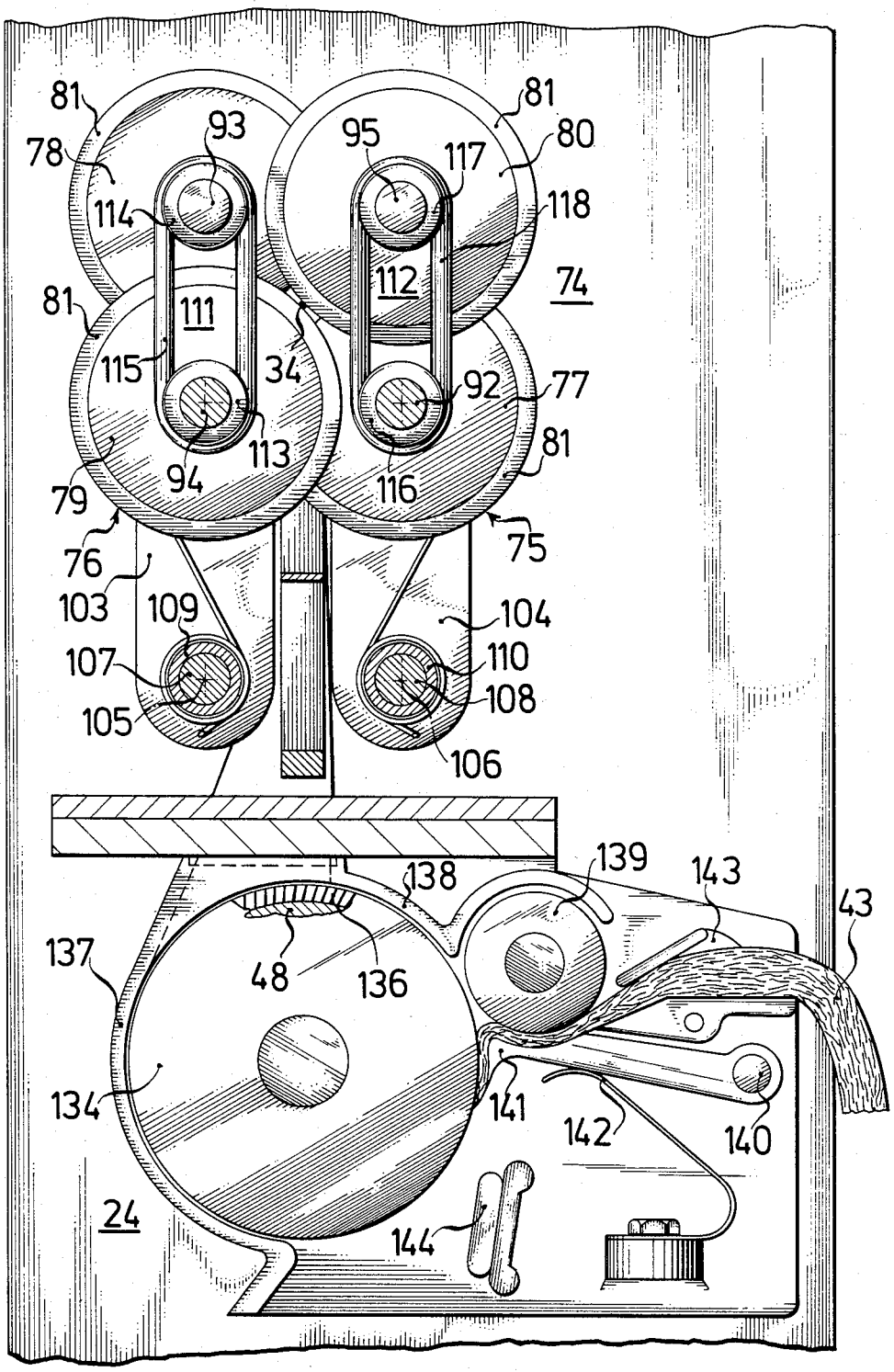
FIG. 4 is a fragmentary front-elevational view of the device according to FIG. 1.

The thread twister 74 consists of two roller pairs 75, 76 which are arranged one behind the other. According to FIG. 4, the roller pair 75 consists of the individual rollers 77, 78, and the roller pair 76 consists of the individual rollers 79, 80. All rollers are of identical design, and, particularly, have the same diameter. Each roller also has an identical friction covering 81. The friction coverings consist of rubber-elastic material. The rollers are mounted on shafts, the roller 77 being mounted on the shaft 92, the roller 78 on the shaft 93, the roller 79 on the shaft 94 and the roller 80 on the shaft 95. First of all, the axes of rotation of the pairs of rollers and shafts are spaced from the longitudinal axis of the thread 34 by the same distance, as is shown in FIGS. 4 and 5. Since all rollers have the same outside diameter, the peripheries of the individual rollers are all spaced from the thread by the same distance, and specifically, they are to be brought close to each other down to a distance which is somewhat smaller than the thread diameter.

The above-described embodiment example, however, shows even a further symmetry in the arrangement of the rollers. According to FIG. 5, the plane 96 going through the axis of rotation of the first roller pair 75 intersects the plane 97 which goes through the axis of rotation of the second roller pair 76 at right angles. This means that in this case all of the rollers are arranged in a square.

FIG. 6 shows that the two roller pairs are brought close together down to a point where they are spaced apart by a small distance. One roller of each roller pair is supported in such a way as to be stationary and the other roller is movably supported. FIG. 4 shows in conjunction with FIG. 2 that the two rollers 77 and 79 are stationary. This is accomplished by the fact that the shafts 92 and 94 are supported in needle bearings 98 and the needle bearings 98 are fastened in the front panel 54. The rollers 77 and 79 which are supported in this stationary manner, have a separate drive which consists of a tangential belt drive 99. According to FIG. 6, this tangential belt drive 99 consists of a tangential belt 100, a knurled element 101 mounted on the shaft 94, and a knurled element 102 mounted on the shaft 92. This measure ensures that the lower roller of each roller pair is driven with a mutually equal circumferential velocity. This is because the two knurled elements also have a mutually equal diameter.

Each of the two movably supported rollers 78, 80 is pivoted at a strap. The roller 78, for instance, is supported on a strap 103, and the roller 80 is supported on a strap 104. The strap 103 can pivot about an axis 105, and the strap 104 can pivot about an axis 106. There are several equivalent ways of achieving this rotatability. In the present case, the strap 103 has a shaft 107, and the strap 104 has a shaft 108. The shaft 107 rests in a bearing bushing 109 and the shaft 108 rests in a bearing bushing 110. Both bearing bushings are fastened in the front panel 54 as is shown in FIG. 2. FIG. 4 shows clearly that the axis 105 is located vertically below the axis of rotation of the roller 79, and the axis 106 is located vertically under the axis of rotation of the roller 77.

While the rollers which are supported in a stationary manner, are driven directly, the movably supported rollers are driven by the stationary rollers. This should not be understood to mean that one roller would always have to drive the other roller directly; rather the functional connection is, indirect and is accomplished by the provision that one stationary roller of the one roller pair is always connected to a movably supported roller of the other pair by drive elements. Thus, the roller 79, for instance, is connected in this case to the roller 78 by a belt drive 111, and the roller 77 is connected to the roller 80 by a belt drive 112, as is shown in FIG. 4. These are round belt drives. Serrated belt drives could also be used.

The belt drive 111 consists of a pulley 113 which is mounted on the shaft 94, a pulley 114 which is mounted on the shaft 93, and a round belt 115 which has a certain amount of elasticity. The belt drive 112 consists of a pulley 116 mounted on the shaft 92, a pulley 117 mounted on the shaft 95 and a round belt 118 which likewise has a certain amount of elasticity.

In FIG. 6, the bearing support of the shafts 93 and 95 in the strap 103 and 104, respectively, can be seen particularly clearly. The strap 103 supports a needle bearing 119 in which the shaft 93 is supported rotatably but secured against axial shifting. The strap 104 supports a needle bearing 120, in which the shaft 95 is supported in a similar manner.

FIG. 5 shows how the movably supported rollers are held in their operating position. In this case a vertical cross piece 119′ is aligned with the two straps 103 and 104, between these straps. The vertical cross piece 119′ is angled-off at its lower end and fastened to the front panel 54. Set screws 120′ and 121 are braced against this cross piece 119′ from the strap 103 and from the strap 104. The contact is in each case aided by springs; specifically, by a wound spiral spring 122 for the strap 103 and a wound spiral spring 123 for the strap 104.

The swivel path of the movably supported rollers 78 and 80 extends from the operating position shown to a joining and inspection position, not shown. The joining and inspection position differs from the operating position in that there is a distance corresponding to several times the thread diameter between the rollers instead of a distance which corresponds maximally to the thread diameter. Thereby, a thread can be taken against the thread-withdrawal direction between the roller pairs in the direction toward the fiber-collecting groove for the purpose of joining. For the purpose of changing from the operating position to the inspection position, the movably supported rollers have a common actuating element, designated overall with reference numeral 124, which is shown in particular in FIGS. 2 and 5. This actuating element 124 consists of a lever 125 fastened to the shaft 107 and a lever 126 fastened to the shaft 108, which are connected to each other in the form of a toggle joint. According to FIG. 2, the lever 125 carries a pin 127, and according to FIG. 5 the lever 126 has an elongated hole 128, through which the pin 127 is pushed. If the pin 127 is moved upwards from the operating position, both levers 125, 126 make contact with the stop 129, through which the joining and inspection position is fixed. One-hand operation is therefore possible by means of the pin 127 with respect to changing from the operating position to the joining and inspection position and vice versa.

For the purpose of a secure guidance of the spun thread in the thread-withdrawal direction and also for introducing a thread into the fiber-collecting groove backwards for the purpose of joining, various thread-guiding means are arranged between the fiber-collecting groove 60 and the thread-withdrawing device 25. Thus, thread-guiding means 130 are arranged, for instance, between the fiber-collecting groove 60 and the thread twister 74. These thread-guiding means consist of a nozzle which is supported by the cross piece 119'. Further thread-guiding means 131 are arranged between the thread-twister 74 and the thread-withdrawing device 25. These thread-guiding means consist of a tube which is inserted into the front panel 54, extends to a location close to the thread twister and is bent in the direction toward the thread-withdrawing device. Other thread-guiding means 132 are arranged between the roller pairs 75 and 76 of the thread twister 74. These thread-guiding means consist of an aperture, the shape of which can be seen particularly in FIG. 5. It has an approximately elliptical shape.

Details of the fiber-opener device 24 are shown particularly in FIG. 4. FIG. 4 shows the opener 24 with the cover 45 flipped open. An opener cylinder 48 equipped with lateral flanges 133, 134 is provided for carrying a needle set 136. The opener cylinder 48 is surrounded by fiber and air-guidance walls 137, 138. The opener cylinder 48 is preceded by a feed cylinder 139. Below the feed cylinder 139 there is a feed tray 141 which can be rotated about the axis 140 and is pushed onto the feed cylinder 139 by a leaf spring 142. The roving 43 is transported through a funnel 143 between the feed tray 141 and the feed cylinder 139. The feed cylinder 139 rotates more slowly than the opener cylinder 48, so that the fibers are continuously picked out of the roving 43 and are isolated. All this happens with the aid of an air-stream, which may be generated in various ways. In the embodiment example, a venting slit 144 is provided through which compressed air flows from a compressed-air canal 145 shown in FIG. 1 into the housing of the fiber-opening device 24, and from there flows together with the opened and isolated fibers 64 into the fiber-guiding canal 51.

To initiate the spinning process, the following preparations are made first:

The opener cylinder and the feed cylinder rotate as do the roller pairs of the thread twister. The bobbin drive cylinder 32 of the thread-winding device 26 and the shaft 28 of the thread-withdrawing device 25 also rotate. The withdrawing roller 29 is not yet applied to the shaft 28. A thread end is introduced through the tube 131, and extends with the aid of the thread-guiding means 130, 132 and through the thread twister which is in the joining position, to the fiber-collecting groove 60, where the thread end is held by the underpressure present. Then, the roving 43 is introduced into the fiber-opening device. As soon as fibers emerge from the fiber-guiding canal 51, which is visible as "fiber snow", the thread twister 74 is set in operation by lowering the pin 127 into the operating position shown in FIG. 2. At the same time, the thread 34 is placed against the cylinder 28, the withdrawing cylinder 29 is applied, the thread end is thrown onto the bobbin 33 or the still empty bobbin tube 33', whereupon the spinning operation proper begins. The thread is now continuously pulled off and wound up and the fibers are likewise continuously fed into the fiber-collecting groove 60. The spinning process continues without interruption until the roving 43 is used up. In the meantime, bobbin changes can be made without interrupting the spinning process. The joining process can be handled manually or by special automatic equipment.

In the alternative embodiment according to FIGS. 7 and 8, the body 146 of the fiber-collecting groove 147 has air-suction nozzles 148, 149 on both longitudinal sides. These two air-suction nozzles are connected by a suction canal 150 to the same underpressure or suction source as the perforation 151, which is a slot in this case. The slot 151 opens into a manifold canal 152, from which a canal 153 extends. A housing 154 which is open on one side and more specifically, toward the bottom and surrounds the body 146 of the fiber-collecting groove 147 at a distance, forms the two air-suction nozzles 148 and 149 at its open side. The housing 154 is connected to the body 146 by spacers 155 and screws 156. The suction canal 150 is brought close to the canal 153 defining to a narrow gap, so that the underpressure acts mainly on the perforation 151 and to a lesser extent on the two air-suction nozzles 148, 149. The fiber-guiding canal 157 extends in this case over the entire width of the fiber-collecting groove 147.

In the alternative embodiment according to FIG. 9, the slit nozzle 158 of the fiber-guiding canal 159 is directed toward one side wall 160 of the fiber-collecting groove 161. The side wall 160 of the fiber-collecting groove 161 is higher than the other side wall 162. Only the higher side wall 160 in this case serves as a sliding surface for the fibers. Otherwise, a perforation 164 is seen at the groove bottom in the body 163, which has connection to a manifold canal 165. The manifold canal 165 leads into a canal 166.

In the alternative embodiment according to FIG. 10, the body 167 of a fiber-collecting groove 168 has perforations 169 in the groove bottom in the form of small holes. The perforations 169 lead into a manifold canal 170 which is formed by a transverse hole and is covered at its ends by covers 171, 172. From the manifold canal 170, a canal 173 leads to a non-illustrated underpressure source. The perforations 169 extend only over part of the length of the fiber collecting groove 168 in this case, and specifically over the part facing away from the thread-withdrawal direction. The thread-withdrawal direction is indicated by an arrow 174. The slit nozzle 175 of the fiber-guiding canal 176, in this case extends only over part of the portion of the fiber-collecting groove 168 provided with perforations 169, and more specifically, over the part facing away from the thread-withdrawal direction.

FIG. 10 also illustrates two roller pairs with 177 and 178, of a thread twister. The thread twister forces a thread twist on the thread 179, as shown. This is an S-twist which is visible on the left-hand side. On the right-hand side, a Z-twist is introduced into the developing thread which, however, is a false twist which is continuously resolved and is no longer visible in the finished thread. If the direction of rotation was reversed, a Z-twist would be present on the left-hand side and an S-twist on the right-hand side.

The drawings of FIGS. 11 and 12, show a further alternative embodiment of the fiber-collecting groove. In this case, the body 180 of the fiber-collecting groove 181 is designed in the form of a box with a stub 182 attached. The perforations form a remarkable combination in this instance. A row of holes 183 is arranged in the vicinity of the groove bottom in the right-hand side wall 184, and an identical row of holes 185 is formed in the left-hand side wall 186. At the groove bottom there is also a perforation 187 in the form of a slot. The manifold canal is divided into the canal halves 188, 189 in this embodiment. Both canal halves lead into a canal 190 which is in the stub 182.

FIG. 14 shows a special embodiment of the design according to FIGS. 11 and 12. The body 191 of the fiber-collecting groove 192 has the shape of a box in this case as well. The side walls 193, 194 are of convex shape. The slot bottom itself has no perforation, but instead, the right-hand as well as the left-hand side wall each have two rows of similar holes 195 in the vicinity of the slot bottom.

The two canal halves 196, 197 are connected on the one hand to the holes 195 and on the other hand, to a canal 198 which is located in a stub 199.

In the further alternative embodiment according to FIG. 13, the fiber-collecting groove 201, located in the body 200, has a lower side wall 202 and a higher side wall 203. Only the side wall 203 in this case is to serve as the sliding surface for the fibers. The side wall 203 is made wavy by six parallel waves 204 in such a way, that the wave bottoms 205 are parallel to the groove bottom 206.

Figure 15:
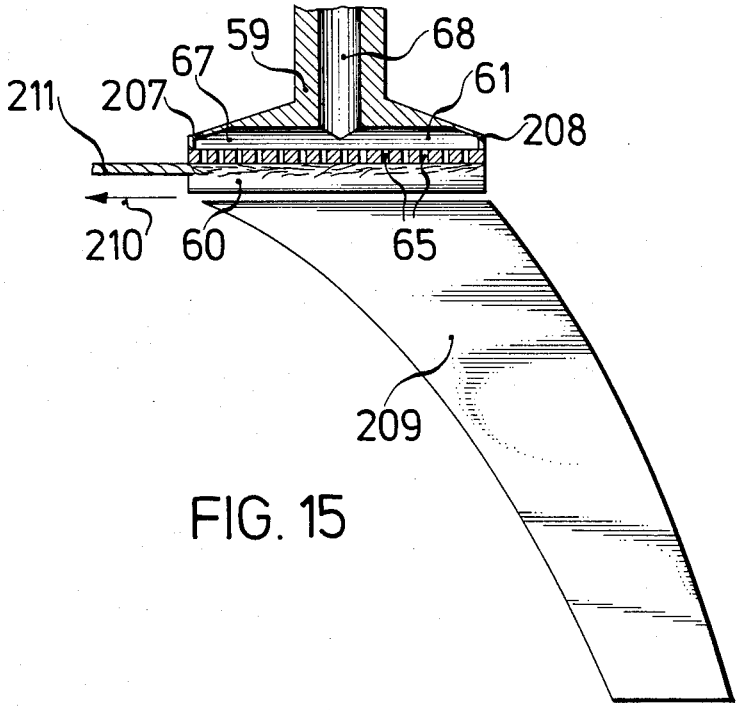
FIGS. 15 and 16 are fragmentary cross-sectional views showing special relationships between the fiber-guiding canal and the fiber-collecting groove.

In the embodiment example according to FIG. 15, the same fiber-collecting groove 60 is provided as in the embodiment example according to FIG. 2. The manifold canal 67 is closed off at its ends by covers 207, 208. The thread-guiding canal 209 provided in this embodiment is inclined from the vertical direction toward the fiber-collecting groove in the thread-withdrawal direction. The thread-withdrawal direction is indicated by an arrow 210. The developing thread is designated with reference numeral 211. The fiber-guiding canal 209 furthermore is arc-shaped and specifically it is also curved in the thread-withdrawal direction.

Figure 16:
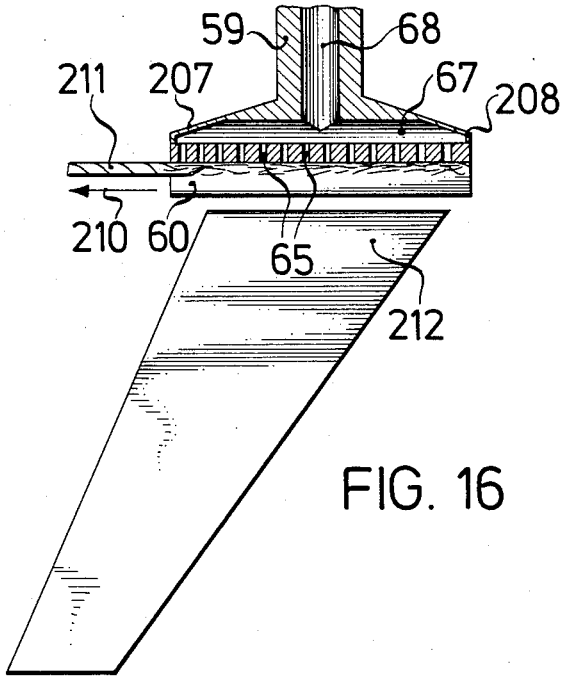

In the further alternative embodiment example according to FIG. 16, the same fiber-collecting groove is provided as in the embodiment example according to FIG. 15. The fiber-guiding canal 212 is inclined in this case toward the thread-withdrawal direction.

The variety of variants disclosed so far is to give suggestions for many combinations to one skilled in the art. If one has layed out, for instance, an assortment of various fiber-collecting grooves and fiber-guiding canals, the best combination can always be selected by spinning tests. In the embodiment example according to FIG. 2, the body 59 of the fiber-collecting groove 60 is held, for instance, only by a screw in the beam 58. The fiber-guiding canal 51 has a plug-in base. These two parts which influence the spinning result can therefore be exchanged with only a few manipulations. Thus, with one and the same open-end spinning device, it is possible to process not only cotton fibers as well as synthetic fibers, but also fibers consisting of animal hair and mixtures of these fibers, into thread.

In another embodiment example, FIG. 17 shows the machine frame 21 of a double-sided open-end spinning machine, the symmetry plane of which extends along the dot-dash line 22. An individual open-end spinning device 23 is shown in a side view. The open-end spinning device 23 comprises a fiber-opener device 24, a thread withdrawal device 25 and a third winding device 26. A side plate 27 supports the thread-withdrawing device 25 as well as the thread-winding device 26. The thread-withdrawing device 25 has a continuously driven shaft 28 going through from one spinning device to another, and a withdrawal roller 29 which can be applied to the shaft 28 and is supported in a rocking lever 30.

The thread-winding device 26 has a continuously rotating shaft 31 which also goes through from device to device and carries a bobbin-driving cylinder 32. The bobbin-driving cylinder 32 frictionally drives a bobbin 33 on which the spun thread 34 is wound. The bobbin 33 is supported by a bobbin holder 35 which can pivot about a shaft 36 fastened in the side plate 27. Another part of the thread-winding device 26 is a reciprocating thread guide 37 which is mounted on a rod which is movable lengthwise and is likewise supported in the side plate 27, and extends continuously from one spinning device to another spinning device. FIG. 17 furthermore shows a thread-guiding bracket 39 shown in cross section.

FIG. 17 shows a knurled drive element 40 and a roving baffle 41, of the fiber-opener device 24. The knurled drive element 40 is driven by a flat belt 42. The roving 43 to be processed is supplied from a can 44.

The roving baffle 41 is mounted on a cover 45 which can be swung about a hinge 46 and is held detachably by a magnetic lock 47. In the interior of the fiber-opener device 24 there is, among other things, an opener cylinder, the shaft 49 of which is connected to the already mentioned knurled element 40. The housing of the fiber-opener device 24 is followed toward the top by a fiber-guiding canal 51.

Extending from the machine frame 21 toward the front is a cross piece 52, to which the base 53 of a front panel 54 is fastened by means of screws. At the right-hand upper corner of the front panel 54, a holding rod 55 is pivoted and secured against shifts in the lengthwise direction. At the end of the holding rod 55 there is a setting lever 56, which can be swung in an angular range limited by stop pins 57. At the other end of the holding rod 55 there is a carrier 58 for the body 59 of a fiber-collecting groove 60. The fiber-collecting groove 60 is shown in its operating position. The setting lever 56 ensures that this operating position is retained a stationary manner without external action.

The cross section through the fiber-collecting groove 60 shown in FIG. 18 shows that the fiber-collecting groove has a V-shaped cross section with a narrowed-down groove bottom 61.

The fiber-collecting groove 60 is elongated and the fiber-guiding canal 51 opens in front of the fiber-collecting groove 60. The side walls 62, 63 of the fiber-collecting groove are smoothed and serve, among other things, as sliding surfaces for the fiber 64 fed-in through the fiber-guiding canal 51. The side walls are not only smoothed but in this case they are also planar walls. The groove bottom 61 has perforations 65. These perforations consist of holes arranged in a row. The perforations 65 are connected to a diagrammatically shown suction or underpressure source 66. For this purpose, a manifold canal 67, which is continued in a canal 68 is connected in the body 59 of the fiber-collecting groove 60. The canal 68 leads into a canal disposed in the support 58, to which a flexible hose 70 which leads to the underpressure source 66 is connected. The perforations 65 extend over the entire length of the fiber-collecting groove 60.

At the fiber-exit point, the fiber-guiding canal 51 forms a slit nozzle 71 which extends parallel to the fiber-collecting groove. The slit nozzle 71 is directed toward the groove bottom 61 but in such a manner that the emerging fibers also still touch the side walls 62 and 63, as is approximately indicated in FIG. 18. The fiber-guiding canal 51 can be displaced in the cross piece 52 in the vertical direction, so that the distance from the slit nozzle 71 to the groove bottom 61 or to the side walls 62 and 63 of the fiber-collecting groove 60 is adjustable.

In the present embodiment example, the fiber-guiding canal 51 is directed perpendicularly to the fiber-collecting groove 60, i.e. according to FIG. 18 it has a symmetry plane 72 which it shares with the fiber-collecting groove 60.

FIG. 17 shows that the thread-withdrawal device 25 is arranged in front of the one end of the fiber-collecting groove 60, and more specifically at a distance from the above-mentioned end of the fiber-collecting groove. The thread-withdrawal device can accordingly be arranged alternatively in a straight extension in front of the end of the fiber-collecting groove or, as in this example, offset slightly to one side. In order to permit this lateral offset of the thread-withdrawal device without detrimental side effects, a thread-guiding tube 51 is provided as the thread-guiding means.

Figure 19:
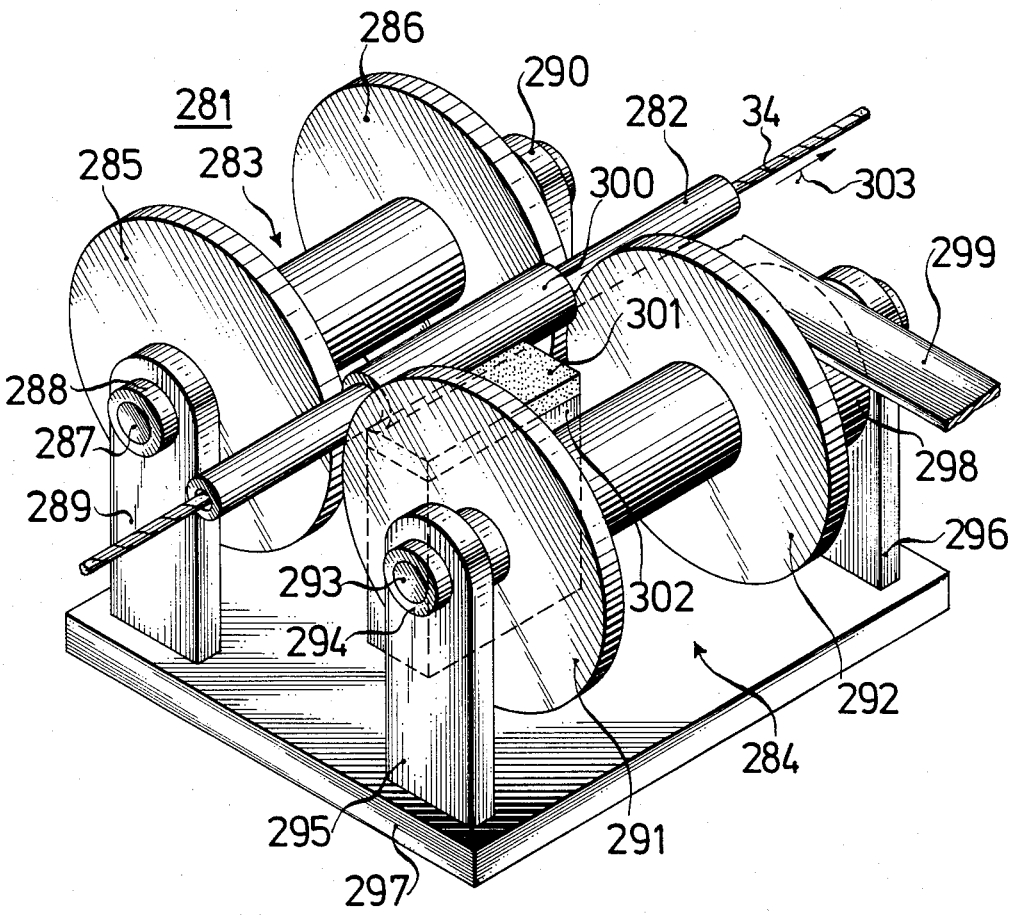
FIG. 19 is a perspective view of a thread twister for the further embodiment.

According to FIG. 17, a thread twister 281 is arranged between the fiber-collecting groove 60 and the thread-withdrawing device 25. The further details of the thread twister 281 are shown in FIG. 19.

The thread twister 281 has a false twist element 282 which consists of a rotary tube. The false twisting element 282 rests on the circumferences of two friction pulley pairs 283 and 284 at four points. The friction pulley pair 283 consists of the friction pulleys 285 and 286 which are fastened on a shaft 287. The shaft 287 is supported by means of anitfriction bearings 288 in pillow blocks 289 and 290. The friction pulley pair 284 consists of the friction pulleys 291 and 292 which are fastened on a shaft 293. The shaft 293 is supported by means of antifriction bearings 294 in pillow blocks 295 and 296. All four pillow blocks are fastened on a base plate 297. Only the shaft 293 carries an external drive in the form of a knurl 298 which is driven by a tangential belt 299. The center of the false twist element 282 carries a sleeve 300 of iron. Under the sleeve 300, is a magnet 301 which is held by a support 302 fastened to the base plate 297.

The false-twist element 282 is held in its position by the force of the magnet 301. The rotary motion is transmitted by the friction pulleys 291 and 292 to the false-twist element 282. The false-twist element 282 in turn sets the friction pulleys 285 and 286 in rotation. The thread 34 is pulled off in the direction of the arrow 303.

The fibers are spread apart with the aid of an air stream, which may be generated in various ways. In the embodiment example, a venting slot 144 is provided through which compressed air from a compressed-air canal 145 flows into the housing of the fiber-opener device 24 and from there, together with the opened separated fiber 64 into the fiber-guiding canal 51.

To initiate the spinning process, the following preparations are made first:

The opener cylinder and the feed cylinder of the fiber opener device 24 rotate. The thread twister is standing still. The bobbin drive cylinder 32 of the thread-winding device 26 and the shaft 28 of the thread-withdrawing device 25 are rotating. The withdrawal cylinder 29 is not yet applied against the shaft 28. A thread end is introduced through the thread-guiding tube 251 and passes through the false-twist element 282 of the thread twister 281 to the fiber-collecting groove 60, where the thread end is held by the underpressure or suction which is present. Then, the roving 43 is introduced into the fiber-opener device 24.

As soon as fibers emerge from the fiber-guiding canal 51, which are visible as "fiber snow", the thread twister 281 is set in operation by lowering the tangential belt 299 into the operating position shown in FIG. 3. At the same time, the thread 34 is placed against the cylinder 28, the withdrawing cylinder 29 is applied, the thread end is thrown onto the bobbin 33 or its still empty bobbin tube 33', and the spinning process proper begins. The thread is now withdrawn continuously and wound up and the continuous feeding of fibers in the fiber-collecting groove 60 also takes place. The spinning process continues without interruption until the roving 43 is used up. Inbetween, bobbins can be exchanged without interruption of the spinning process. The manipulations of the joining process can be performed by hand or by special automatic equipment.

The invention is not limited to the embodiment examples shown and described. A sufficient number of suggestions for further variants are contained in the text and in the drawings.

I claim:

1. Method for open-end spinning, in an apparatus having a stationary fiber-collecting groove formed therein with two ends and a bottom, which comprises continuously carrying and transporting fibers into the stationary fiber-collecting groove with an air-stream, continuously venting the bottom of the groove, withdrawing the fibers from one end of the groove, and continuously uniting the fibers to form a thread.

2. Method according to claim 1, which comprises forming side walls of the groove converging toward the bottom of the groove.

3. Method according to claim 1, which comprises venting the bottom of the groove by force.

4. Method according to claim 1, which comprises forcing a longitudinal twist on the thread in vicinity of the fiber-collecting groove.

5. Method according to claim 1, which comprises feeding the fibers to the fiber-collecting groove in the form of a fiber balloon.

6. Open-end spinning device, comprising a body having a stationary elongated fiber-collecting groove formed therein from which fibers are withdrawn to form a thread in a given fiber travel direction, defining ends of said groove and a bottom of said groove having at least one vented perforation formed therein, a fiber-guide canal upstream of said groove in said given fiber travel direction for discharging fibers in front of said fiber-collecting groove, a fiber opener device connected to and downstream of said fiber-guide canal, and a thread-withdrawing device downstream of one of said ends of said fiber-collecting groove.

7. Open-end spinning device according to claim 6, wherein said body has side walls of said groove formed therein converging toward said bottom of said groove.

8. Open-end spinning device according to claim 6, including a thread twister disposed between said fiber-collecting groove and said thread-withdrawing device.

9. Open-end spinning device according to claim 6, wherein said fiber-collecting groove is longer than the length of the fibers to be processed.

10. Open-end spinning device according to claim 6, wherein said fiber-collecting groove has a V-shaped cross-section.

11. Open-end spinning device according to claim 7, wherein said side walls are convex.

12. Open-end spinning device according to claim 7, wherein said side walls are concave.

13. Open-end spinning device according to claim 7, wherein said side walls are smoothed sliding surfaces for the fibers.

14. Open-end spinning device according to claim 7, wherein said side walls are planar.

15. Open-end spinning device according to claim 7, wherein at least one of said side walls have waves formed therein defining wave troughs extended parallel to said bottom of said groove.

16. Open-end spinning device according to claim 7, wherein one of said side walls is higher than the other and is a sliding surface for the fibers.

17. Open-end spinning device according to claim 6, wherein said perforations are in the form of a slot extended along the length of the bottom of the groove.

18. Open-end spinning device according to claim 6, wherein said perforations are in the form of a row of holes.

19. Open-end spinning device according to claim 6, including a suction source connected to said perforations.

20. Open-end spinning device according to claim 6, wherein said body has two longitudinal sides having air exhaust openings formed therein.

21. Open-end spinning device according to claim 6, including a housing surrounding said body at a distance, said housing having an open side forming air exhaust nozzles.

22. Open-end spinning device according to claim 6, wherein said body is swingable from an operating position to an inspection position and is lockable in said operating position.

23. Open-end spinning device according to claim 7, wherein said fiber-guide canal has a fiber outlet slot nozzle formed therein extended parallel to said fiber-collecting groove.

24. Open-end spinning device according to claim 23, wherein said slot nozzle is directed toward said bottom of said groove.

25. Open-end spinning device according to claim 23, wherein said slot nozzle is directed against one of the side walls of said groove.

26. Open-end spinning device according to claim 6, wherein said fiber-guide canal is perpendicular to said fiber-collecting groove.

27. Open-end spinning device according to claim 6, wherein said fiber-guide canal is inclined relative to said fiber-collecting groove in said thread travel direction.

28. Open-end spinning device according to claim 6, wherein said fiber-guide canal is inclined relative to said fiber-collecting groove against said thread travel direction.

29. Open-end spinning device according to claim 7, wherein said fiber-guide canal is arcuate.

30. Open-end spinning device according to claim 8, wherein said fiber-guide canal is arcuate.

31. Open-end spinning device according to claim 23, wherein part of said groove is provided with said perforations, and said slot nozzle extends over said part of said groove.

32. Open-end spinning device according to claim 8, wherein said thread twister includes two roller pairs with axes of rotation diposed one behind the other, said axes of said roller of said roller pairs being equidistant from the longitudinal axis of the thread, and said rollers having peripheries being at least as close to each other as a distance equal to the diameter of the thread.

33. Open-end spinning device according to claim 32, wherein all of said rollers of said roller pairs are driven in the same direction with the same circumferential velocity.

34. Open-end spinning device according to claim 32, wherein said rollers of one of said roller pairs have axes of rotation in a plane substantially perpendicular to a plane passing through said axes of rotation of said rollers of the other of said roller pairs.

35. Open-end spinning device according to claim 32, wherein one of said rollers of each of said roller pairs is supported in a stationary manner and the other of said rollers of each of said roller pairs is supported in a movable manner.

36. Open-end spinning device according to claim 35, including drive elements connecting said stationary roller of each one of said roller pairs to said movable roller of the other roller pair.

37. Open-end spinning device according to claim 35, wherein said movably supported rollers are swingable from an operating position to a spinning-start and inspection position, and said peripheries of said rollers being spaced apart from each other by a distance equal several times the diameter of the thread.

38. Open-end spinning device according to claim 6, including thread-guiding means disposed between said fiber-collecting groove and said thread-withdrawing device.

39. Open-end spinning device according to claim 8, including thread-guiding means disposed between said fiber-collecting groove and said thread twister.

40. Open-end spinning device according to claim 8, including thread-guiding means disposed between said thread-withdrawing device and said thread twister.

41. Open-end spinning device according to claim 8, including thread-guiding means disposed between said fiber-collecting groove and said thread twister, as well as between said thread-withdrawing device and said thread twister.

42. Open-end spinning device according to claim 39, wherein said thread-guiding means are in the form of a nozzle.

43. Open-end spinning device according to claim 40, wherein said thread-guiding means are in the form of a tube.

44. Open-end spinning device according to claim 32, including thread-guiding means disposed between said roller pairs of said thread twister.

45. Open-end spinning device according to claim 44, including another body disposed between said roller pairs, said thread-guiding means being in the form of an aperture formed in said other body.

46. Open-end spinning device according to claim 8, wherein said thread twister includes a false twist element.

47. Open-end spinning device according to claim 46, wherein said false twist element is a rotating tube.

48. Open-end spinning device according to claim 46, wherein said thread twister includes two pairs of friction pulleys and a magnet, said false twist element being held against the peripheries of said pulleys at a total of four points by said magnet.

49. Open-end spinning device according to claim 48, including at least one external drive element for one of said pulleys.

* * * * *